US010154722B2

(12) United States Patent
Tian

(10) Patent No.: US 10,154,722 B2
(45) Date of Patent: Dec. 18, 2018

(54) ANTI-SLIP STRAP

(71) Applicant: Ruiyang Tian, Lebanon, NH (US)

(72) Inventor: Ruiyang Tian, Lebanon, NH (US)

( * ) Notice: Subject to any disclaimer, the term of this patent is extended or adjusted under 35 U.S.C. 154(b) by 0 days.

(21) Appl. No.: 15/439,940

(22) Filed: Feb. 23, 2017

(65) Prior Publication Data

US 2017/0238683 A1 Aug. 24, 2017

Related U.S. Application Data

(60) Provisional application No. 62/298,381, filed on Feb. 22, 2016.

(51) Int. Cl.
*A45F 3/12* (2006.01)
*F41C 33/00* (2006.01)

(52) U.S. Cl.
CPC ..... *A45F 3/12* (2013.01); *F41C 33/002* (2013.01)

(58) Field of Classification Search
CPC . A45F 3/12; A45F 3/04; F41C 33/002; A45C 13/30
See application file for complete search history.

(56) References Cited

U.S. PATENT DOCUMENTS 5,292,044 A * 3/1994 Reimers ..... A45F 3/12 224/257
6,179,178 B1 * 1/2001 Stegmeyer ..... A45C 13/30 224/257
6,318,609 B1 * 11/2001 Swierz ..... A45F 3/12 2/460
2003/0046750 A1 * 3/2003 D'Addario ..... A45F 3/12 2/268
2004/0185247 A1 * 9/2004 Fenton ..... A45F 3/12 428/327
2005/0040684 A1 * 2/2005 Yoshiguchi ..... A45F 3/12 297/228.13
2005/0258205 A1 * 11/2005 French ..... A45F 3/12 224/264
2008/0138565 A1 * 6/2008 Yang ..... A45F 3/12 428/107
2014/0205787 A1 * 7/2014 Ou ..... B32B 3/04 428/71
2017/0196347 A1 * 7/2017 Sawhney ..... A45F 3/12

* cited by examiner

*Primary Examiner* — Corey N Skurdal
(74) *Attorney, Agent, or Firm* — Yi Zhang

(57) ABSTRACT

A shoulder strap pad has a generally rectangular/oval base and a plurality of nodules integral to the generally rectangular base. The generally rectangular/oval base has a top surface, a bottom surface and opposite ends. A soft pliable strip extends from the opposite ends when the shoulder strap pad is connected to the soft pliable strip. The nodules project outward from the bottom surface of the generally rectangular base and are arranged in spaced-apart relationship with respect to each other.

14 Claims, 4 Drawing Sheets

ANTI-SLIP STRAP

CROSS-REFERENCE TO RELATED APPLICATIONS

This application claims priority to U.S. provisional patent application No. 62/298,381, filed Feb. 22, 2016, the disclosure of which is incorporated herein by reference.

FIELD OF THE INVENTION

The present invention generally relates to a pad for a shoulder strap that is used for carrying a load from the shoulder.

BACKGROUND OF THE INVENTION

A typical carrying strap, for example, a carrying strap for a rifle, golf bag, is constructed with a strap of leather or canvas as the primary load-bearing member and a wider and thicker layer of foam or other suitable padding placed between the strap and the wearer's shoulder. A typical carrying strap sometimes tends to slip or roll from the shoulder. Anti-slip carrying straps are available on the market. The anti-slip carrying straps available on the market tend to prevent slip in one direction, e.g., lateral, but not in other directions, e.g., longitudinal. Accordingly, there is a continuing need for a pad that prevents the carrying strap from slipping off the shoulder.

SUMMARY OF THE INVENTION

The present invention provides an anti-slip pad for a shoulder strap.

In one embodiment, the anti-slip pad has a generally rectangular/oval base with a top surface, a bottom surface and opposite ends. When the shoulder strap pad is connected to a soft pliable strip, the soft pliable strip extends from the opposite ends of the pad. The anti-slip pad has a plurality of nodules integral with the generally rectangular/oval base and projects from the bottom surface, wherein the plurality of nodules are arranged in spaced-apart relationship with respect to each other.

In another embodiment, the anti-slip pad has a plurality of depressed members integral to the generally rectangular/oval base and caving from the bottom surface, wherein the plurality of depressed members are arranged in spaced-apart relationship with respect to each other. In certain embodiment, each of depressed members comprises at least one nodule extending from the bottom of each of the plurality of depressed member.

These and other features, aspects, and advantages of the present invention will become better understood with regard to the following description, appended claims and accompanying drawings.

DETAILED DESCRIPTION OF THE INVENTION

Figure 1:
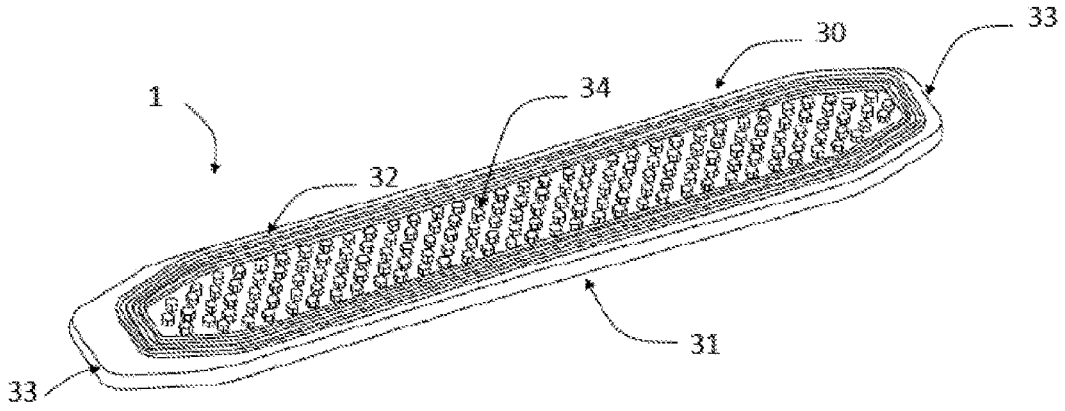
FIG. 1 shows the perspective view of an exemplary anti-slip pad in a carrying strap.

In the Summary of the Invention above and in the Detailed Description of the Invention, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where a range of value is provided, it is understood that each intervening value, to the tenth of the unit of the lower limit unless the context clearly dictate otherwise, between the upper and lower limit of that range and any other stated or intervening value in that stated range, is encompassed within the disclosure, subject to any specifically excluded limit in the stated range. Where the stated range includes one or both of the limits, ranges excluding either or both of those included limits are also included in the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, the embodiments described herein can be practiced without there specific details. In other instances, methods, procedures and components have not been described in detail so as not to obscure the related relevant function being described. Also, the description is not to be considered as limiting the scope of the implementations described herein. It will be understood that descriptions and characterizations of the embodiments set forth in this disclosure are not to be considered as mutually exclusive, unless otherwise noted.

The following definitions are used in the disclosure:

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)~(a second number)," this means a range whose lower limit is the first number and whose upper limit is the second number. For example, 25 to 100 mm means a range whose lower limit is 25 mm, and whose upper limit is 100 mm.

The invention is now described in detail by referring to specific embodiments (some of which are preferred embodiments). However, it should be understood by those having skill in the art that various changes in form and detail may be made therein without departing from the spirit and scope of the present invention as disclosed herein.

Figure 2:
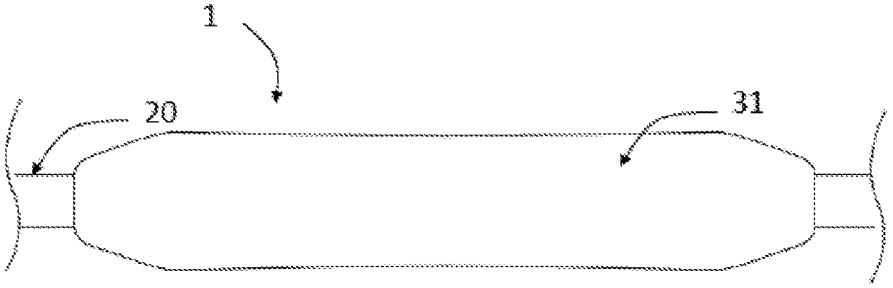
FIG. 2 shows the top view of the anti-slip pad in a carrying strap illustrated in FIG. 1.
Figure 3:
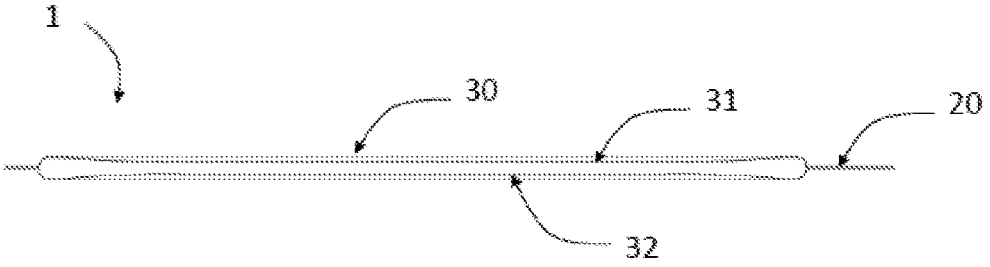
FIG. 3 shows the side view of the anti-slip pad in a carrying strap illustrated in FIG. 1.

Referring initially to FIGS. 1-4 of the drawings, in a preferred embodiment the anti-slip pad, hereinafter referred to as the pad, of this invention is generally illustrated by reference number 1. The pad 1 comprises a generally rectangular base 30. The base 30 has a top surface 31, a bottom surface 32 and opposite ends 33. Referring to FIG. 2, a soft, pliable strip 20 extends longitudinally from the opposite ends 33. The pad 30 has multiple parallel, adjacent, diagonal rows of multiple, resilient nodules 34, each of which projects outward from the bottom surface 32 in spaced-apart relationship with respect to each other.

The strip 20 is typically constructed of leather, canvas or vinyl plastisol using conventional techniques well-known to those in the art.

The pad 30 is made of a flexible and resilient material. Typically, the pad 30 is constructed of thermoplastic elastomer (TPE) vinyl plastisol (e.g., polyvinyl chloride (PVC)) or silicone using conventional molding techniques well-known in the art. In certain embodiments, the pad 30 is constructed of thermoplastic vulcanizate (TPV), thermoplastic polyurethane (TPU) or thermoplastic polyether ester elastomer (TPEE).

Figure 4:
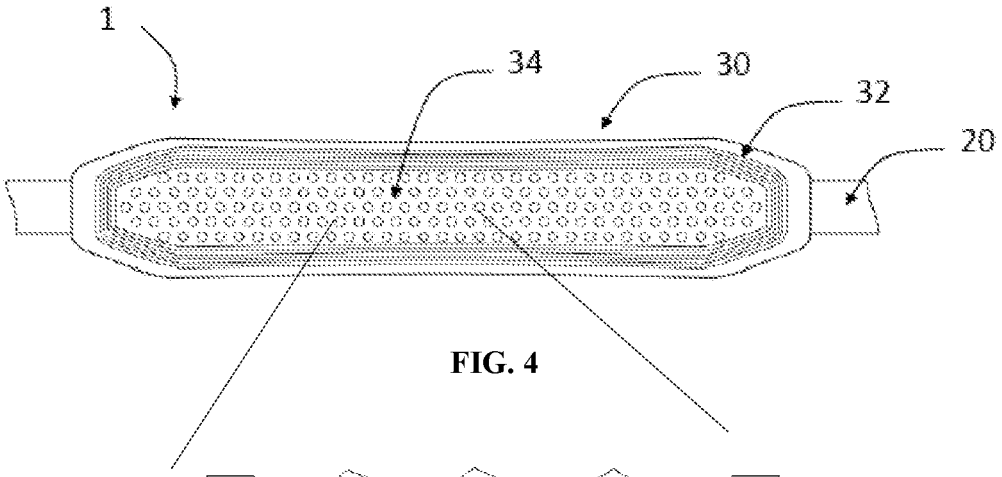
FIG. 4 shows the bottom view of the anti-slip pad in a carrying strap illustrated in FIG. 1.
Figure 4A:
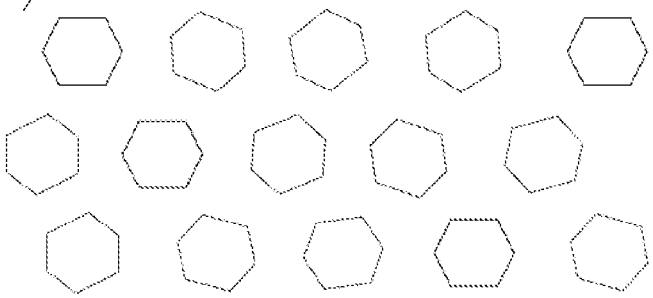
FIG. 4A shows an enlarged view of the arrangement of the nodules projected from the bottom of the anti-slip pad illustrated in FIG. 4.
Figure 4B:
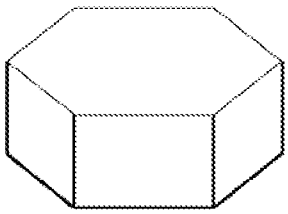
FIG. 4B shows an enlarged view of an exemplary nodule projected from the bottom of the anti-slip pad illustrated in FIG. 4.

In a preferred embodiment, each of the nodules 34 comprises a polygonal column having a diameter ranging from 2~5 mm (about 2, 2.5, 3, 3.5, 4, 4.5, 5 mm, preferably about 3 mm) and having a height ranging from 0.5~3 mm (about 0.5, 1, 1.5, 2, 2.5, 3, 3.5, 4, 4.5 5 mm, preferably about 1.5 mm). In certain embodiments, each of the nodules 34 is a triangle, quadrilateral, square, pentagonal, hexagonal, heptagonal, octagonal column. In certain embodiment, each of the nodules has a generally flat top surface. In certain embodiments, the edge of the top surface is non-curved. (i.e., the top surface of the column is substantially flat and perpendicular to the side surface of the column). In certain embodiment, the nodules of polygonal column shape are placed so that the edges of the polygonal columns are not parallel (FIG. 4A). Such design increases the friction of the strap in all directions.

Figure 5:
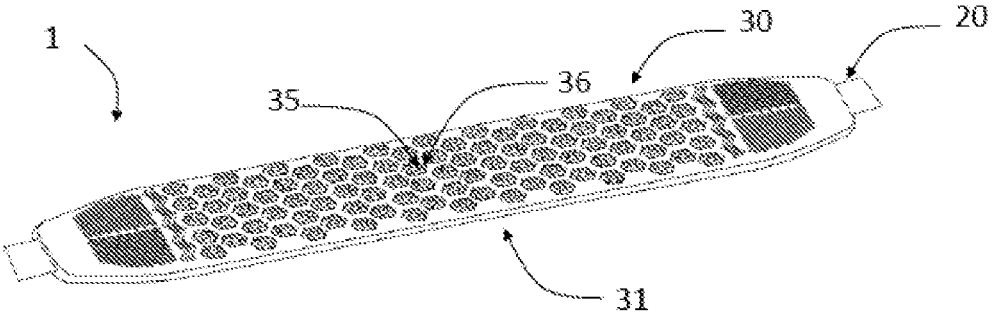
FIG. 5 shows the perspective view of an exemplary anti-slip pad in a carrying strap.
Figure 6:
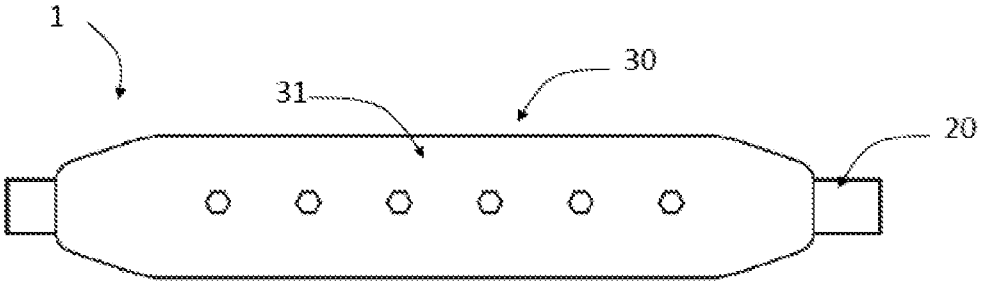
FIG. 6 shows the top view the anti-slip pad in a carrying strap illustrated in FIG. 5.
Figure 7:
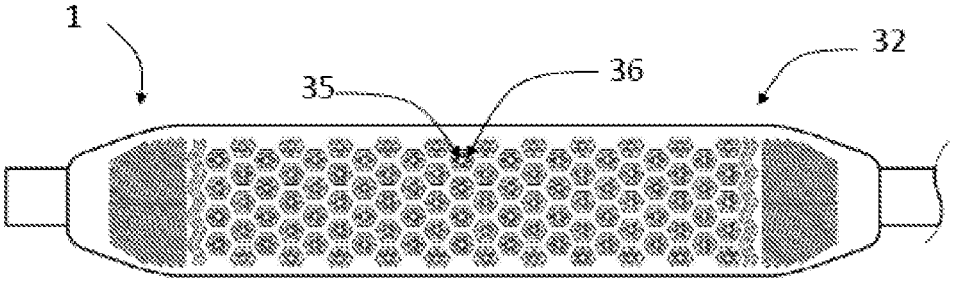
FIG. 7 shows the bottom view of the anti-slip pad in a carrying strap illustrated in FIG. 5.

Referring to FIGS. 5-7 of the drawings, in another preferred embodiment, the anti-slip shoulder pad 1 comprises a generally rectangular base 30. The base 30 has a top surface 31, a bottom surface 32 and opposite ends 33. A soft pliable strip 20 extends longitudinally from the opposite ends 33. The pad 1 has multiple parallel, adjacent, diagonal rows of depressed member 35, each of which caves inward from the bottom surface 32 in spaced-apart relationship with respect to each other. Each of the depressed members 35 has at least one nodule 36 extending outward from the bottom of each of the depressed member 35.

In a preferred embodiment, each of the depressed member 35 has a depth ranging from 0.5~5 mm (about 0.5, 1, 1.5, 2, 2.5, 3, 3.5, 4, 4.5, 5 mm) and a diameter ranging from 2~10 mm (about 2, 3, 4, 5, 6, 7, 8, 9, 10 mm, preferably about 5 mm). The nodule 36 has a height ranging from 0.2~5 mm and a diameter ranging from 0.5~5 mm.

EXAMPLE

This example illustrates a comparison of the anti-slip effects of different straps used in rifle slings. Three straps used in rifle slings available on the market were compared to an exemplary anti-slip strap of the present disclosure. The exemplary anti-slip strap has a design as illustrated in FIG. 1. Specifically, the strap was made of thermoplastic rubber using conventional molding techniques. The nodules on the strap had a hexagonal column shape of about 1.5 mm in height and about 3 mm in diameter. The nodules were arranged in multiple parallel rows. The nodules were spaced at about 5 mm.

Figure 8:
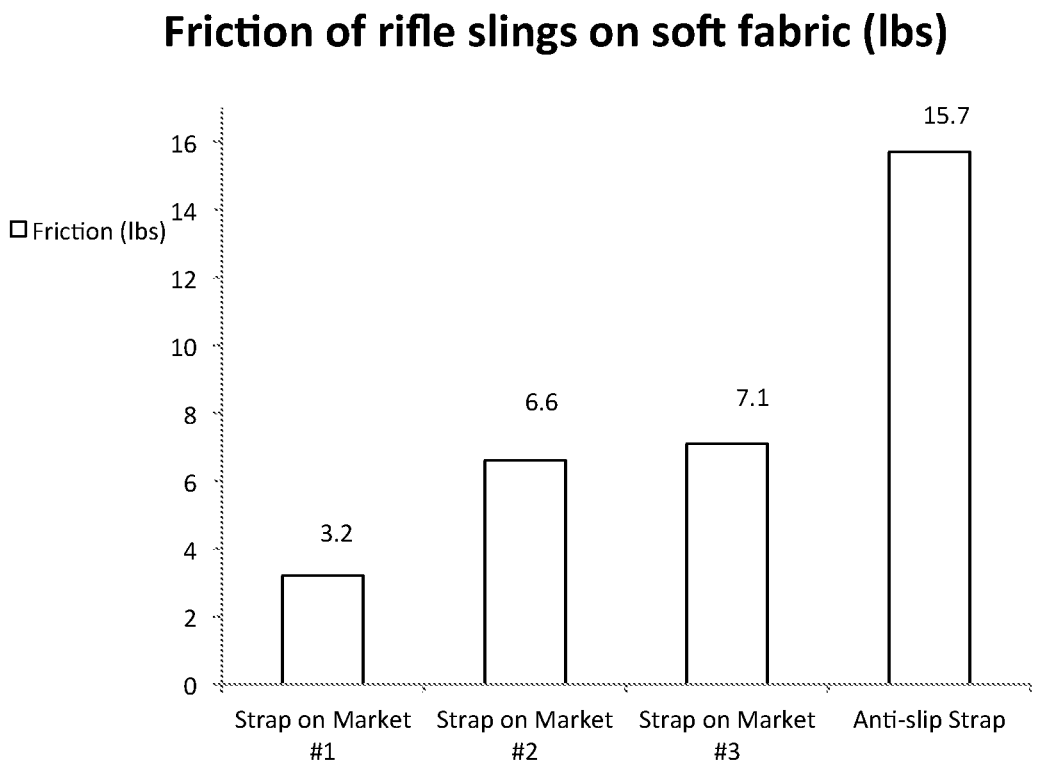
FIG. 8 shows the comparison of the anti-slip effects of different straps used in rifle slings.

To conduct the comparison, the rifle slings were placed on soft fabric to mimic rifle slings on shoulder. Five-pound weight was added onto the top of each gun slings. The friction was measured by pulling the slings on soft fabric with a digital hanging scale. The readings were recorded. As shown in FIG. 8, the anti-slip strap of the present disclosure exhibited a significantly higher friction (more than double) than the commercially available straps.

What is claimed is:

1. A shoulder strap pad capable of preventing from slipping off the shoulder, said shoulder strap pad comprising:

a generally rectangular/oval base with a top surface, a bottom surface and opposite ends, wherein a soft pliable strip extends from the opposite ends when the shoulder strap pad is connected to the soft pliable strip; and a plurality of nodules integral with said generally rectangular/oval base and projecting outward from the bottom surface, wherein each of the plurality of nodules has about a same shape, wherein the plurality of nodules are arranged in spaced-apart relationship with respect to each other, wherein each of the nodules has the shape of a polygonal column, wherein each of the nodules has a diameter of about 5 mm, and wherein each of the nodules projects about 2~3 mm from the bottom surface.

2. The shoulder strap pad of claim 1, wherein each of the nodules has the shape of a triangle, quadrilateral, pentagonal, hexagonal, heptagonal, octagonal column.

3. The shoulder strap pad of claim 1, wherein each of the nodules has a generally flat top surface.

4. The shoulder strap pad of claim 3, wherein the flat top surface has a non-curved edge.

5. The shoulder strap pad of claim 1, wherein the first plurality of nodules are arranged in a staggered pattern on the bottom surface.

6. The shoulder strap pad of claim 1, wherein the plurality of nodules are arranged in a pattern of multiple parallel rows.

7. The shoulder strap pad of claim 1, wherein the generally rectangular/oval base and the plurality of nodules are made of a flexible and resilient material.

8. The shoulder strap pad of claim 7, wherein the flexible and resilient material is thermoplastic elastomer (TPE), Polyvinyl chloride (PVC) or silicone.

9. The shoulder strap pad of claim 8, wherein the TPE is selected from the group consisting of thermoplastic vulcanizate (TPV), thermoplastic polyurethane (TPU) and thermoplastic polyether ester elastomer (TPEE).

10. A shoulder strap pad comprising a generally rectangular/oval base having a top surface a bottom surface and opposite ends, wherein a soft pliable strip extends from the opposite ends when the shoulder strap pad is connected to the soft pliable strip; and a plurality of depressed members integral to the generally rectangular/oval base and caving from the bottom surface, wherein each of the depressed member has about a same shape, wherein the plurality of depressed members are arranged in spaced-apart relationship with respect to each other, wherein each of the depressed member comprises at least one nodule projecting from the bottom of each of the plurality of depressed member, wherein the at least one nodule has a diameter ranging from 0.5~5 mm, and wherein the at least one nodule has a height ranging from 0.2~5 mm.

11. The shoulder strap pad of claim 10, wherein the plurality of depressed members are arranged in a staggered pattern on the bottom surface.

12. The shoulder strap pad of claim 10, wherein each of the depressed member has a polygonal shape.

13. The shoulder strap pad of claim 10, wherein each of the depressed member has a depth ranging from 0.5~5 mm.

14. The shoulder strap pad of claim 10, wherein each of the depressed member has a diameter ranging from 2~10 mm.

* * * * *